United States Patent [19]

Reed

[11] Patent Number: 4,872,317

[45] Date of Patent: Oct. 10, 1989

[54] UNITARY ICE MAKER WITH FRESH FOOD COMPARTMENT AND CONTROL SYSTEM THEREFOR

[75] Inventor: William A. Reed, Cedarburg, Wis.

[73] Assignee: U-Line Corporation, Milwaukee, Wis.

[21] Appl. No.: 261,801

[22] Filed: Oct. 24, 1988

[51] Int. Cl.[4] ..... F25C 1/00

[52] U.S. Cl. ..... 62/135; 62/189; 62/233; 137/624.11; 251/129.04

[58] Field of Search ..... 251/129.04; 137/624.11; 62/135, 158, 233, 189, 138

[56] References Cited

U.S. PATENT DOCUMENTS

| | | | |
|---|---|---|---|
| 2,801,526 | 8/1957 | Solley, Jr. | 62/6 |
| 3,225,559 | 12/1965 | Fischer | 62/180 |
| 3,280,578 | 10/1966 | Linstromberg | 62/137 |
| 3,327,493 | 6/1967 | Jacobus | 62/137 |
| 3,788,089 | 1/1974 | Graves | 62/137 |
| 4,191,025 | 3/1980 | Webb | 62/135 |
| 4,325,223 | 4/1982 | Cantley | 62/126 |
| 4,589,435 | 5/1986 | Aldrich | 137/624.11 |
| 4,706,703 | 11/1987 | Kawasaki | 251/129.04 |
| 4,774,814 | 10/1988 | Yingst et al. | 62/126 |

*Primary Examiner*—William E. Wayner

*Attorney, Agent, or Firm*—Quarles & Brady

[57] ABSTRACT

An ice maker includes an interior volume containing a freezer compartment and a fresh food compartment. The freezer compartment houses an automatic ice making unit, including an ice mold, a water solenoid valve for admitting water into the ice mold, and a first thermistor attached to the ice mold. A second thermistor is disposed in the fresh food compartment. A microprocessor based control unit monitors the first and second thermistors to determine when to initiate ice harvest cycles. Ice harvest cycles are delayed, if necessary, to maintain the fresh food compartment below a setpoint temperature. The control unit also includes sensing means for determining if the water solenoid valve is energized. The solenoid is monitored, and if it remains energized for a prolonged period, then power to the automatic ice making unit is removed to prevent excessive water spillage.

8 Claims, 7 Drawing Sheets

FIG. 2
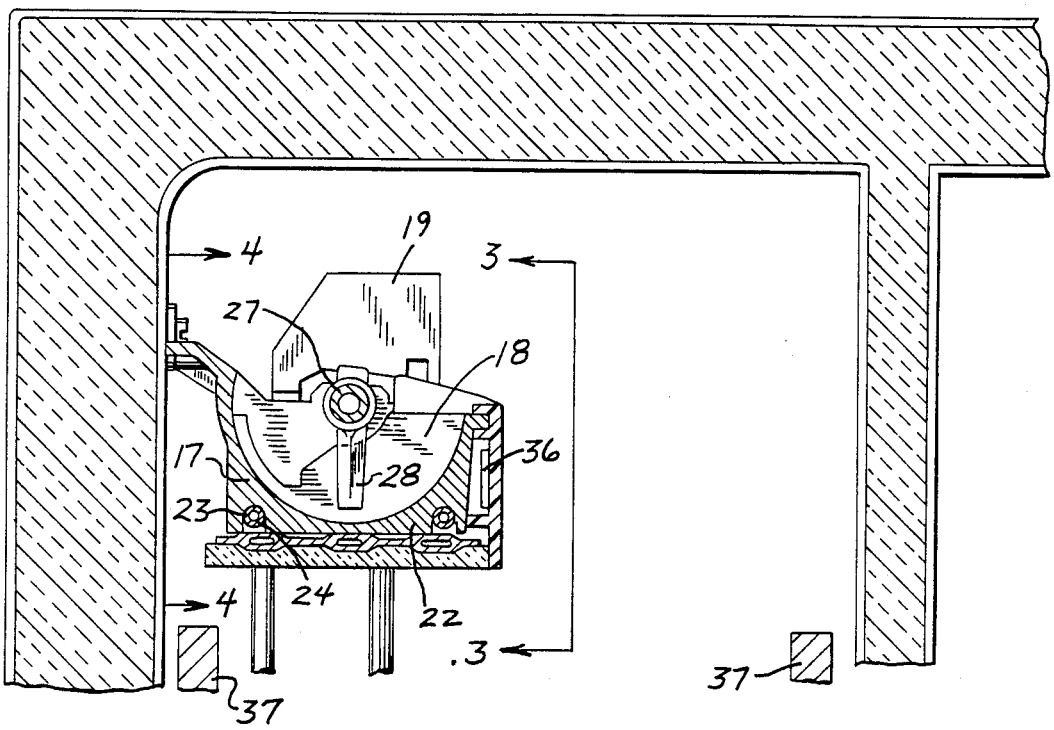
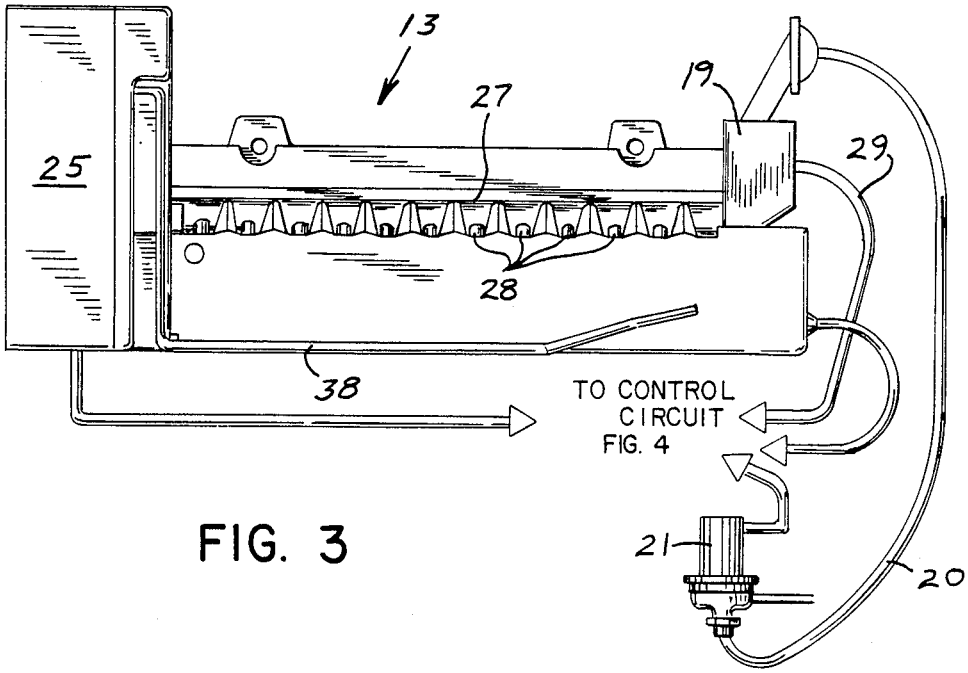
FIG. 3

UNITARY ICE MAKER WITH FRESH FOOD COMPARTMENT AND CONTROL SYSTEM THEREFOR

BACKGROUND OF THE INVENTION

The field of the invention is compact unitary ice cube makers with refrigerated compartments, and more particularly, to control systems therefor.

Compact ice makers include an automatic ice making unit for maintaining a ready supply of ice cubes. Such ice automatic ice making units are generally known, and include an ice mold and means for filling the ice mold with water, usually via a solenoid controlled water valve. It should be understood that the term "ice cube" is used to refer to any shape, not limited to perfect cubes. Most ice molds for automatic ice making produce "half moon" shaped wedges for ease in freezing and harvesting.

When the water freezes in the ice mold, its temperature drops below freezing. A single sensor located on the ice mold is used to sense the ice mold temperature. When that temperature falls below a predetermined setpoint temperature, the ice in the mold is frozen and ready to be harvested. The ice is typically harvested by a gear reduction, high torque motor which either drives the ice out of the mold, or otherwise rotates or twists the mold to release the ice. An ice mold heater is commonly employed during the harvesting operation to produce localized melting at the interface between the ice and the mold, thereby facilitating release of the ice. Normally, a refrigeration compressor is run constantly until the ice harvest is initiated. Then the compressor is shut off during the ice harvest cycle so as not to oppose the ice mold heater. After the harvest cycle is complete, the compressor is restarted to freeze another batch of ice.

Compact unitary ice cube makers of the above described type are commonly used in homes and small offices to provide for both the production of ice cubes and the refrigerated storage of other items, for example, beverages and perishable foodstuffs, at a temperature above freezing in a "fresh food compartment". When the ice maker also includes a fresh food compartment, the freezer section with the automatic ice making unit is located in a separate section adjoining the fresh food compartment.

In such applications, e.g. ice maker with fresh food compartment, the production of ice at a maximum rate is the controlling factor for the refrigeration system. In other words, the refrigeration system is controlled by the ice making mechanism, or process, as described above. The compressor operates continuously until the ice in the mold is frozen. Then, the compressor is shut off while the ice is harvested. After the harvest, the compressor is again engaged until the next batch of ice is frozen.

If ice is withdrawn from the reservoir on the average at a rate approximating the ice production capacity, the above described cycle for control of the compressor repeats indefinitely. If ice is not used as fast as it is produced, it accumulates in a reservoir, or bin. A switch is usually provided to detect a full bin condition, in which case ice harvesting is suppressed until the full bin condition is relieved.

One problem associated with prior ice makers with fresh food compartments of the type just described is that the temperature of the fresh food compartment is subject to wide variation, especially towards warmer temperatures. The only source of cooling for the fresh food compartment is the freezer compartment, specifically an evaporator in contact with the ice mold used to produce the ice. This is usually enough to maintain the ice stored in the bin in a frozen condition. Extraneous heat losses, for example opening the ice maker door, can cause the temperature in the fresh food compartment to rise even though ice is still being satisfactorily produced in the automatic ice making unit. As stated above, the control system for such prior ice makers is adapted of optimum ice production without regard to the temperature in the fresh food compartment, and so the temperature in the fresh food compartment is essentially uncontrolled One prior solution addressing this problem is described in U.S. Pat. No. 3,788,089, in which a system of baffles and apertures are placed so as to achieve a cooling air exchange between the freezer and fresh food compartment which serves to moderate the temperature of the latter. While this approach is generally satisfactory, the lack of refrigeration during ice harvesting and other variables, for example the number of door openings and the amount and temperature of the articles placed in the fresh food compartment, may result in temporarily warmer temperatures in the fresh food compartment.

SUMMARY OF THE INVENTION

A unitary ice maker with fresh food compartment according to the present invention includes the customary fresh food compartment, freezer compartment containing an automatic ice making unit, and refrigeration means for producing ice in the automatic ice making unit. The automatic ice making unit in turn includes an ice mold, a first temperature sensing means in thermal contact with the ice mold for producing a first signal indicative of the temperature of the ice mold, and means for harvesting ice from the ice mold. The improvement in the unitary ice maker with fresh food compartment according to this invention additionally provides the inclusion of a second temperature sensing means and an improved ice maker control means. The second temperature sensing means is exposed to the fresh food compartment, and produces a second temperature signal indicative of the temperature of the interior of the fresh food compartment. The ice maker control means is connected to the refrigeration means and to the first and second temperature signals. The ice maker control means determines when it is time to initiate an ice harvest in the automatic ice making unit by monitoring the first temperature signal to determine the time at which ice in the automatic ice making unit is ready to be harvested, and at that time, then monitoring the second temperature signal to determine if the temperature of the fresh food compartment is below a predetermined setpoint temperature. If at the time that the ice in the automatic ice making unit is ready to be harvested, the temperature of the fresh food compartment is above the setpoint temperature, then the ice harvest is delayed to allow additional cooling of the fresh food compartment.

An object of the present invention is to provide a lower temperature and a better regulated temperature in the fresh food compartment. By utilizing a second temperature sensing means, the ice harvesting cycle can be altered, when required, to allow the refrigeration means to continue in operation before shutting down for an ice harvest cycle. Additional cooling is thereby imparted tot he fresh food compartment. The first and second temperature sensing means may each comprises a thermistor and the ice maker control means may comprise a microprocessor system including memory means. Additionally, the value of the setpoint temperature may be stored in the memory means and the microprocessor system may include input/output means for manually setting the value of the setpoint temperature.

In another aspect of this invention, an ice maker of the type which includes an automatic ice making unit with a water solenoid valve for admitting water into an ice mold, further includes sensing means for sensing the presence of an energizing voltage on the water solenoid valve, on/off control means for removing operating voltage from the automatic ice making unit, and ice maker control means for preventing prolonged water flow through the water solenoid valve. The sensing means is connected to the water solenoid valve and produces a solenoid active signal when the energizing voltage is present. The ice maker control means is connected to the sensing means and to the on/off control means, and acts to prevent prolonged water flow through the water solenoid valve by monitoring the solenoid active signal. If the solenoid active signal remains true for a period of time exceeding a first predetermined time period, then the ice maker control means de-activates the on/off control means to remove the operating voltage from the automatic ice making unit, thereby de-energizing the water solenoid valve.

Another object of this invention is the protection against damage due to water spillage caused by the water solenoid valve being energized for a prolonged period of time. Another object of this invention is to attempt to clear the condition in which the solenoid valve is energized for a prolonged period. Once the on/off control means is deactivated in response to the solenoid active signal exceeding the predetermined time limit, the ice maker control unit waits for a second predetermined time period, and then reactivates the on/off control means to again apply operating voltage to the automatic ice making unit. If, after reactivation of the on/off control means, the solenoid active signal again remains true for a period of time exceeding the first predetermined time period, then the on/off control means is again deactivated. The reactivation of the on/off control means may be attempted a maximum of three times, after which if the solenoid active signal continues to exceed the first predetermined time period, then the on/off control means remains deactivated until reset through manual intervention.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 2 is a sectional view taken on line 2—2 of FIG. 1 showing the automatic ice making unit which forms a part of the ice maker of FIG. 1;

FIG. 3 is a right side view of the automatic ice making unit as viewed from line 3—3 of FIG. 2;

DESCRIPTION OF THE PREFERRED EMBODIMENT

Figure 1:
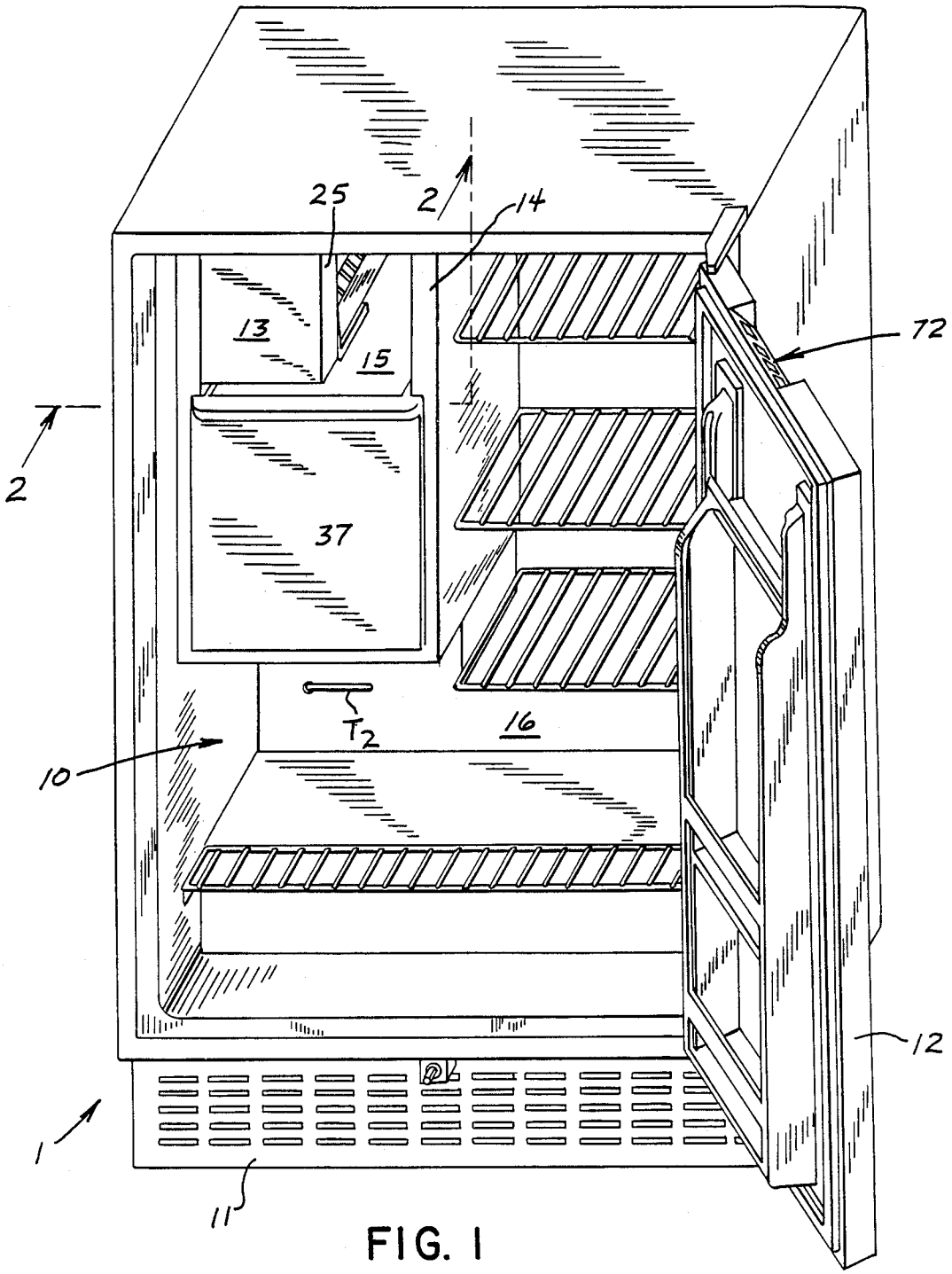
FIG. 1 is a perspective view of an ice maker according to the present invention.

Referring to FIG. 1, an ice maker 1 according to the present invention includes an insulated main interior volume 10 covered by an insulating door 12. A machinery chamber (not shown) is located at the bottom of the ice maker 1 and houses the mechanical components of the ice maker 1, e.g. a compressor, condenser, and control circuits. A perforated grill 11 on the front of the ice maker provides air passage to the machinery chamber for cooling the mechanical components.

A generally L-shaped inner insulated wall 14 divides the main volume 10 into a freezer compartment 15 and a fresh food compartment 16. An automatic ice cube making unit, indicated generally by the numeral 13, is mounted in the upper left hand corner of the freezer compartment 15. Although an ice maker 1 according to this invention may utilize a one stage or multiple stage evaporator, all evaporator stages are located in the freezer compartment; there is no direct cooling of the fresh food compartment.

Prior control systems for ice makers provided for production of ice at a maximum rate. That is, the compressor was operated only long enough to freeze the current charge of water into ice, and then shut off to harvest the ice. The fresh food compartment is cooled by virtue of heat transfer to the freezer compartment, e.g. the presence of ice and the cooling provided by the evaporator. In prior units of this type, proper temperature maintenance of the fresh food compartment 16 was a particular problem. Baffling schemes have been used to provide some temperature stabilization, but even then, unpredictable factors, for example excessive door opening, could cause wide temperature variations, leading to premature spoilage of perishables and objectionable temperatures for beverages and other consumables.

In the present invention, these problems are overcome by a novel control system, described below, which maintains a stable temperature in the fresh food compartment 16 integrally with the production of ice. In particular, an ice maker according to this invention includes two separate temperature sensing elements. A first temperature sensing element in the automatic ice making unit is used for controlling the production of ice, and a second temperature sensing element is disposed in the fresh food compartment, and is utilized in the ice harvesting control described below to stabilize the temperature of the fresh food compartment.

Referring still to FIG. 1, in this embodiment the second temperature sensing element is a thermistor, designated herein as $T_2$, located adjacent to the back wall of the fresh food compartment 16. Thermistor T2 is utilized in a novel control system, described below, to control the production and harvesting of ice so as to maintain the fresh food compartment 16 at a stable temperature.

Figure 4:
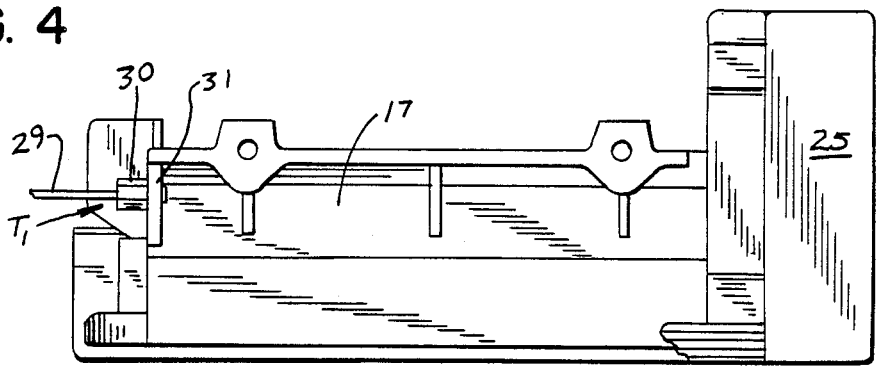
FIG. 4 is a left side view of the automatic ice making unit as viewed from line 4—4 of FIG. 2.

Referring to FIGS. 2 and 4, the automatic ice making unit 13 includes a standard commercially available mechanism comprising a die cast ice cube mold 17 divided by partitions 18 to form independent cavities for holding water to be frozen into ice cubes. A rear wall of the ice cube mold 17 supports an inlet 19 having water passages which open into the mold 17. The open end of a water supply line 20 is received within the inlet 19 so that water flowing through the line 20 will be introduced within the individual cavities in the mold 17. Control of the flow through the water supply line 20 is provided by a solenoid operated valve 21 feeding into line 20.

The bottom wall 22 of the mold 17 is provided with a U-shaped groove 23 which receives an electric mold heater 24. When energized, the electric mold heater 24 warms the mold 17 to loosen the ice cubes formed therein. A control casing 25 is disposed on the front of the mold 17 and houses a electric ice harvest motor 26 (not visible in FIGS. 2 and 3) which functions as part of an ejector mechanism. The ice harvest motor 26, when energized, rotates a shaft 27 extending along the length of the mold 17. The shaft 27 mounts a series of spaced blades 28 which sweep through the individual cavities in the mold 17 during a revolution of the shaft 27, thereby ejecting the ice cubes out of their respective cavities and into an ice drawer 37 disposed beneath the ice maker unit 13. The ice harvest motor 26 is gear reduction motor, providing a speed of three revolutions per minute (RPM). A stripper heater 36 may be employed in the form of a heater wire sandwiched between aluminum foil disposed against the outer side of the ice cube maker unit 13 to control the buildup of frost on the unit 13.

In prior ice making units, the temperature sensor for detecting the freezing of the water in the ice mold comprised a conventional thermostatic switch. The thermostatic switch operated by means of a capillary tube disposed along the side of, and in contact with, the ice mold. The thermostatic switch also included a knob for adjusting the setpoint temperature. In the present invention, the first temperature sensor, designated herein as $T_1$, comprises an electrical transducer which produces a signal related to the temperature of the transducer. The transducer signal is then connected to a control circuit, described below, which is then able to perform the control of the ice making unit 13.

The use of an electronic transducer $T_1$ to sense the temperature of the ice mold 17 is an important aspect of this invention. Several problems arise in attempting to use an electronic transducer $T_1$. First, because of their small size, heat transfer between the ice mold 17 and the electronic transducer $T_1$ is much more critical than in the case of the prior thermostatic switch. The result of poor heat transfer between the electronic transducer $T_1$ and the ice mold 17 is a time lag between the actual temperature of the ice mold and the instantaneous temperature being indicated by the electronic transducer $T_1$. That lag in temperature readings in turn results in a loss of efficiency, e.g. in the production rate of ice, because the compressor must be operated an additional amount of time. Secondly, and again because of the small size of the electronic transducer $T_1$, the electronic transducer $T_1$ responds only to the temperature at essentially one point on the ice mold 17, and the temperature at different points on the ice mold may vary. Depending on the point chosen, some cubes in the mold may be under-frozen, resulting in soggy, quick melting cubes, or over-frozen, again resulting in a loss of efficiency. Applicant has determined that these problems may be overcome through proper placement of the electronic transducer $T_1$ on the ice mold 17 and proper thermal contact between the electronic transducer $T_1$ and the ice mold 17.

Figure 5:
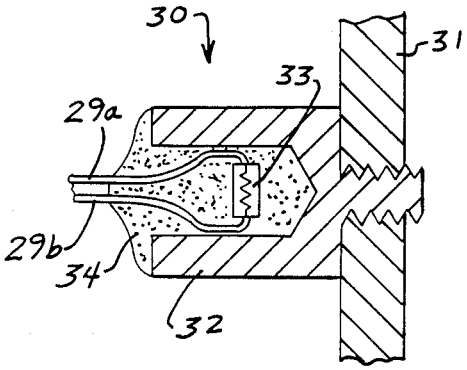
FIG. 5 is a sectional view taken on line 5—5 of FIG. 4.

Referring to FIGS. 4 and 5, an electronic transducer $T_1$ is utilized as the first temperature sensor for the ice making unit 13 mentioned above, and comprises a thermistor assembly 30 mounted on the back of the ice cube mold 17. Thermistor assembly 30 is connected to a control circuit, to be described later, by a cable 29. In the detailed sectional view of FIG. 5, thermistor assembly 30 is shown to comprise an outer stud shell threaded directly into the back wall 31 of the ice mold 17. A thermistor 33 is disposed in the interior of the stud shell 32, and is encapsulated with a thermally conductive compound 34. The cable 29 comprises a pair of leads *29a* and *29b* extending into the encapsulating compound 34 and connected to the ends of thermistor 33.

The structure and placement of the thermistor assembly 30 are important to the efficient operation of the ice making unit 3. Excellent thermal conductivity with minimal thermal time lag are provided by the threading of the stud shell 32 directly onto the ice mold 17, resulting in a short thermal path between thermistor 33 and the ice mold 17. The placement of the ice mold temperature sensor in prior ice making units was not a concern because the action of the thermostatic switches with capillary tubes used in those prior units was inherently slow, and by its very nature produced a temperature reading averaged over the entire ice mold. The inherent lag in temperature response was unavoidable, as was the resulting loss in the ice production rate.

In this invention the electronic transducer, $T_1$ responds essentially instantaneously, and may therefore sense freezing of ice in the mold faster than prior thermostatic switches. However, in order to utilize that faster response, placement of the electronic transducer $T_1$ must be considered. As stated above, the electronic transducer $T_1$ responds to the temperature at only one point on the ice mold 17; the temperature at other points may be different. Specifically, applicant has determined that due to the admission of relatively warm water at the water inlet 19, water in that portion of the ice mold 17 is the last to freeze solidly. If the thermistor assembly 30 is placed in the same position as the capillary tube used in prior thermostatic switches, e.g. along the side in the middle or the front portion of the ice mold 17, then ice near the water inlet 19 may not be solidly frozen at the time the sensed temperature falls below the setpoint. In that case, it would either be necessary to discharge partially frozen ice, or to wait an extra amount of time to insure uniform freezing, thereby degrading the ice production rate. Clearly, both of those alternatives are undesirable. Placement of the thermistor assembly 30 near the water inlet 19, or on the back 1 of the ice mold 17 in this embodiment, thereby provides the fastest and most reliable temperature indication, resulting in a maximum production rate for uniformly frozen ice cubes.

It should be apparent to those skilled in the art that the electronic transducer $T_1$ may comprise sensors other than the disclosed temperature sensitive resistor 33, for example, linear solid state temperature transducers or other temperature sensitive elements.

Referring primarily to FIG. 3, a sensing arm 38 is provided to detect if the ice drawer 37 is full of ice. The sensing arm 38 is linked to a bin switch 39, not shown in this figure, which operates to suspend the harvesting of ice if the ice drawer 37 is indeed full.

HARDWARE DESCRIPTION

Figure 6:
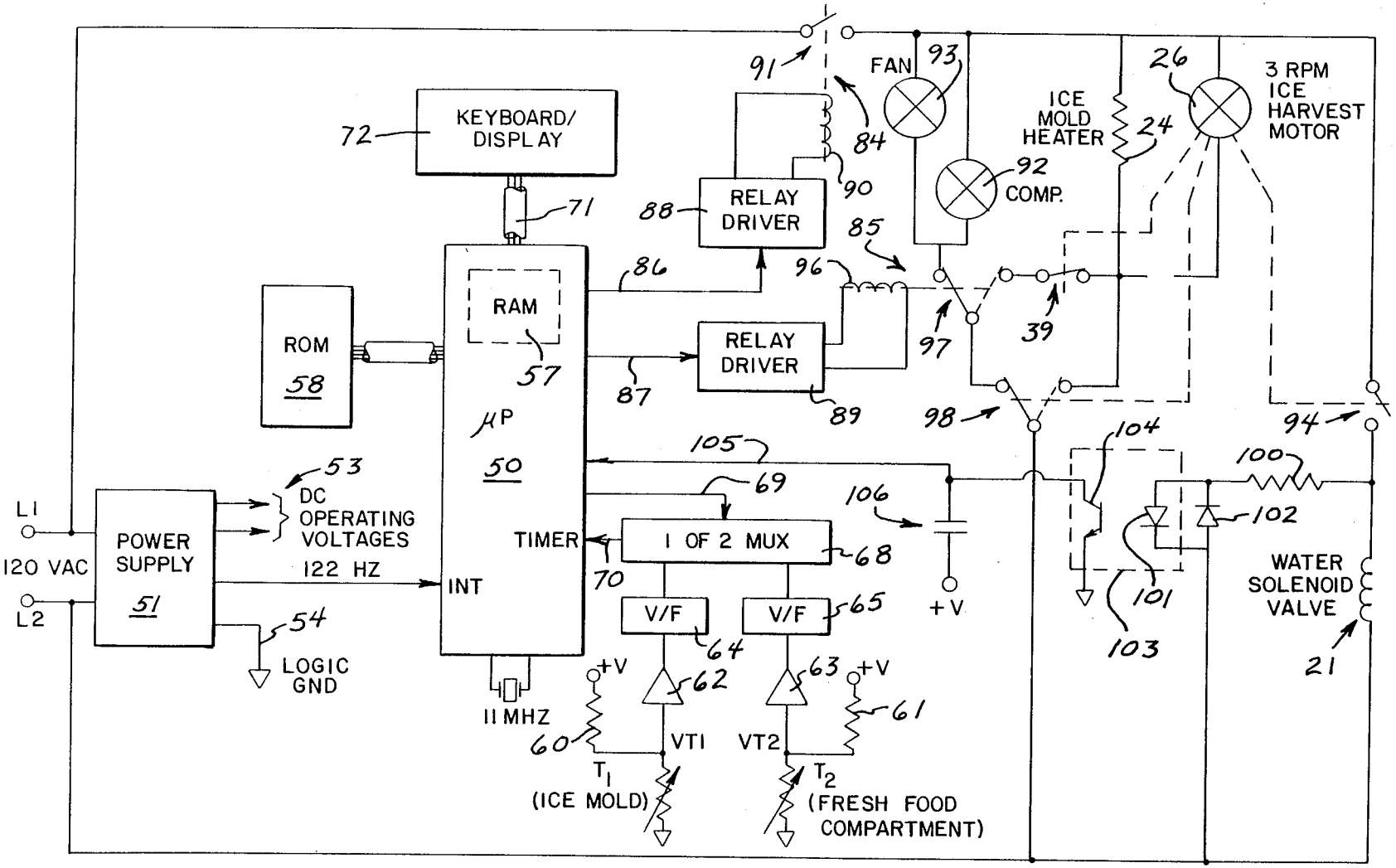
FIG. 6 is schematic diagram of the control circuit which forms a part of the ice maker of FIG. 1.

Referring to FIG. 6, the control system for the ice maker is based on a microprocessor 50. The ice maker 1 operates from a nominal 60 Hz, 120 volt, alternating current (VAC) supply, comprising two input leads L1 and L2. A power supply 51 connects to the 120 VAC input and provides direct current (DC) voltages 53, with respect to a logic ground 54, which are used for operation of the control system. The power supply 51 also provides a full wave rectified, buffered, double frequency (120 Hz) signal 55 connected to the "interrupt" input of the microprocessor 50 for use in maintaining real time clock and timing functions.

Figure 7:
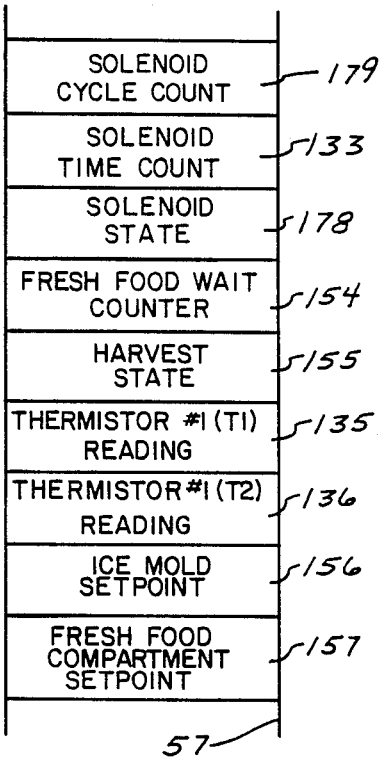
FIG. 7 is a partial memory map for the random access memory which forms a part of the control circuit of FIG. 6.

The microprocessor 50 preferred for this embodiment is a type 8039A, manufactured by Intel Corp., Santa Clara, Calif. The microprocessor 50 contains an internal random access memory (RAM) 57, and is connected externally to a read only memory (ROM) 58 and an 11 Mhz crystal 59. The ROM 58 stores the programs executed by the microprocessor 50 and other fixed data, including constants and look-up tables, used by those programs. The RAM 57 provides read/write storage for program variables, a partial table of which is shown in FIG. 7. The use of those program variables is discussed below in the software description.

As discussed above, the first temperature sensor $T_1$ senses the ice mold temperature and the second temperature sensor $T_2$ senses the temperature in the fresh food compartment 16. Sensor $T_2$, like sensor $T_1$, includes a temperature sensitive resistor, e.g. thermistor, as the sensing element. The thermistor for sensor $T_2$ is contained in a tubular probe extending into the fresh food compartment as shown in FIG. 1. Sensors $T_1$ and $T_2$ are each connected in series with a supply resistor 60 and 61, respectively, between a supply voltage (+V) and ground 54. At the series junction between the supply resistors 60 and 61, and the thermistors $T_1$ and $T_2$, voltages $V_{T1}$ and $V_{T2}$ are formed, respectively. The values of the voltages $V_{T1}$ and $V_{T2}$ are determined by the resistance, and therefore by the temperature, of their respective sensors $T_1$ and $T_2$.

The voltages $V_{T1}$ and $V_{T2}$ are separately applied through buffer amplifiers 62 and 63 t the input of "voltage to frequency" (V/F) converters 64 and 65, respectively. V/F converters 64 and 65 each include a calibration adjustment (not shown) to compensate for circuit and part tolerances. The digital outputs of the V/F converters 64 and 65 are then applied to the data inputs of a two line multiplexer 68. The control input for the multiplexer 68 is provided by the microprocessor 50 on line 69. The output 70 of the multiplexer 68 is connected as a timer input to the microprocessor 50. By appropriate setting of the multiplexer control input 69, the microprocessor 50 is able to monitor the digital frequency output corresponding to either sensor $T_1$ or sensor $T_2$, and is thereby able to determine their respective temperatures. The readings obtained from the thermistors in sensors $T_1$ and $T_2$ are stored in RAM 57 at the locations indicated by the reference numerals 135 and 136, respectively.

Figure 8:
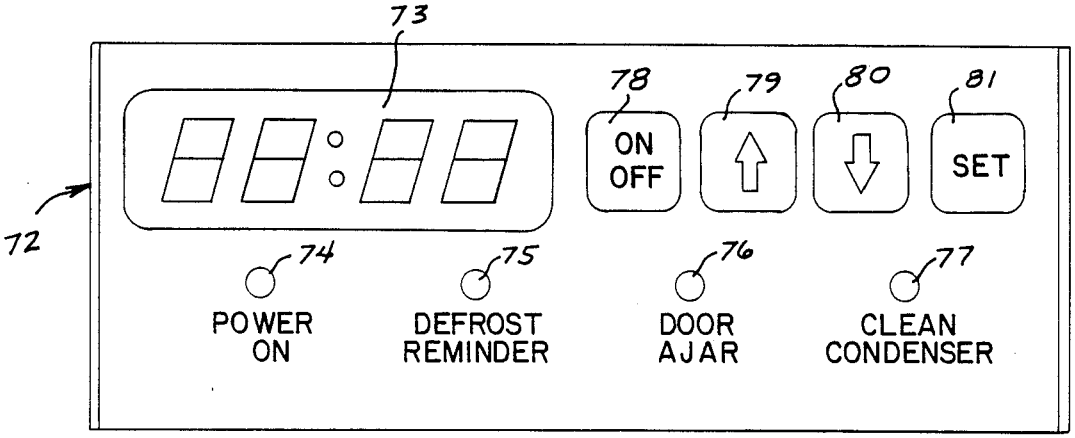
FIG. 8 is a pictorial representation of the keyboard-/display unit which forms a part of the control circuit of FIG. 6.

The control system also includes a keyboard/display unit 72 interfaced to the microprocessor 50 via a bus 71. As shown in detail in FIG. 8, the keyboard/display unit 72 provides a four digit numeric display 73, discrete indicators 74–77 for specific conditions, and switches 78–81 for providing manual input to the microprocessor 50. The keyboard/display unit 72 provides an operator interface capability for accepting operator inputs and displaying requested information. An operator is thereby able to interrogate and set various parameters in RAM 57, including an ice mold setpoint temperature 156, and a fresh food compartment setpoint temperature 157 (FIG. 7) to be used by the programs described below.

The microprocessor 50 controls the automatic ice making unit 13 through the use of two relays; an ON/-OFF relay 84, and an ice harvest relay 85. Those relays 84 and 85 are controlled by the microprocessor 50 via output lines 86 and 87 acting through relay drivers 88 and 89, respectively. The ON/OFF relay 84 comprises a coil 90 linked to a set of single throw, normally open contacts 91. The contacts 91 are in series with lead L1 and provide basic on/off control for the automatic ice making unit 13. Through contacts 91, when closed, the L1 supply voltage is applied to one input of a compressor motor 92, condenser cooling fan 93, ice mold heater 24, ice harvest motor 26, and a set of contacts 94 for energizing the water solenoid valve 21.

The ice harvest relay 85 includes a coil 96 linked to a set of double throw contacts 97. When water in the ice mold 17 is in the process of being frozen, the compressor motor 92 and condenser fan 93 are energized by applying the L2 supply voltage through a set of hold contacts 98 and double throw contacts 97 to the other input of the fan 93 and compressor motor 92. In that position, the relay 85 is termed herein to be in the "compressor" position.

When the microprocessor 50 determines, according to the control scheme of this invention described below, that it is time to initiate an ice harvest cycle, the ice harvest relay 85 is placed in the alternate position, termed the "ice harvest" position. With the ice harvest relay 85 in the "ice harvest" position, supply voltage L2 is removed from the fan 93 and compressor motor 92, and is instead applied to the ice harvest motor 26 and ice mold heater 24 through normally closed bin switch 39. The bin switch 39 is actuated by sensing arm 38, as mentioned above in relation to FIG. 3, to indicate if the ice drawer 37 is already full of ice cubes. If the sensing arm 38 is being held up by a full load of ice in the ice drawer, then the bin switch 39 is held open and an ice harvest cycle can not be initiated.

The hold contacts 98 are driven by a cam (not shown) which is linked to the ice harvest motor 26. Once an ice harvest cycle is initiated, the ice harvest motor 26 begins rotating. After a small amount of rotation, the cam causes the hold contacts 98 to switch to their alternate position, applying L2 directly to the ice harvest motor 26 and mold heater 24 for the remainder of the ice harvest cycle. At the same time, supply voltage L2 is removed from the ice harvest relay contacts 97, thereby preventing the compressor 92 from running during an ice harvest cycle, even if the the ice harvest relay 85 is returned to the "compressor" position.

As the ice harvest motor 26 continues to turn, the ejector blades 28 urge the ice cubes out of the ice mold 17 and into the ice drawer 37. Sensing arm 38 is lifted up by a cam linked to the ice maker motor 26, thereby temporarily forcing open the bin switch 39. At the end of the ice harvest cycle, the sensing arm 38 is lowered towards its normal position. If the ice drawer 37 is full, the sensing arm 38 will be held up by the mound of ice cubes and the bin switch 39 will be held open. If the full ice drawer condition occurs further ice harvest cycles will then be precluded until some ice is removed from the ice drawer 37. If the ice drawer 37 is not full, however, the bin switch 51 will close when released by the cam, allowing further ice harvest cycles.

Contacts 94 for the control of the water solenoid valve 21 are also driven by a cam (not shown) linked to the ice harvest motor 26. The cam is arranged to close the contacts 94 for a period of from 5 to 8 seconds at the end of an ice harvest cycle, after the frozen ice cubes have been expelled, to deliver a new charge of water into the ice mold 17 to be frozen.

One aspect of this invention is to monitor the voltage applied to the water solenoid valve 21 to determine if the contacts 94, or the ice harvesting mechanism driving them, have become stuck or jammed in the closed position. If that were to happen, water would continue to run, overflowing tee ice mold 17, with the potential for causing great damage to both the ice maker 1 and the premises in which it is located. In the present invention, the control circuit includes means for monitoring the voltage on the water solenoid valve 21. If the valve 21 is energized for an excessive period of time during an ice harvest cycle, control operations are performed by the microprocessor 50, described below, to attempt to clear the fault and, if necessary, shut down the ice maker completely to de-energize the water solenoid valve 21.

The voltage on the water solenoid valve 21 is sensed by dropping resistor 100 connected in series with a pair of diodes 11 and 102 connected in anti-parallel. Diode 101 is a light emitting diode (LED) which forms a part of an optical isolator 103. During positive half cycles of the voltage on the water solenoid valve 21, LED 101 is forward biased and emits light coupled to phototransistor 104 in the optical isolator 103. The other diode 102 prevents large reverse bias voltages from being applied to the LED 101 during negative voltage half cycles.

The phototransistor 104 is connected between logic ground 54 and an input 105 to the microprocessor 50. When illuminated by LED 101, the phototransistor 104 conducts, thereby applying a "low" logic voltage to the microprocessor input 105. When LED 101 is off, internal biasing of the microprocessor input tends to bias line 105 towards a logic "high" value. Alternatively, an external biasing resistor (not shown) may be used. A capacitor 106 is connected to the microprocessor input 105, and is sized such that the logic "low" caused by conduction of the phototransistor 104 is maintained between alternate positive half cycles of the 60 Hz voltage in which the phototransistor 104 is conducting. When the AC voltage is removed from the water solenoid valve 21, the LED 101 remains dark and the phototransistor 104 remains off. Then, after approximately one half second without conduction by phototransistor 104, capacitor 106 charges to a logic "high" value, indicating the absence of voltage on the water solenoid valve 21.

SOFTWARE DESCRIPTION

The ice maker 1 is controlled by firmware which resides in the ROM 58 and is executed by the microprocessor 50. The firmware implements a control strategy providing capabilities not found in prior ice maker control systems, namely the capability to maintain the fresh food compartment 16 at a more constant temperature and the capability to detect prolonged water fill time periods. The implementation of those capabilities is now described.

Figure 9:
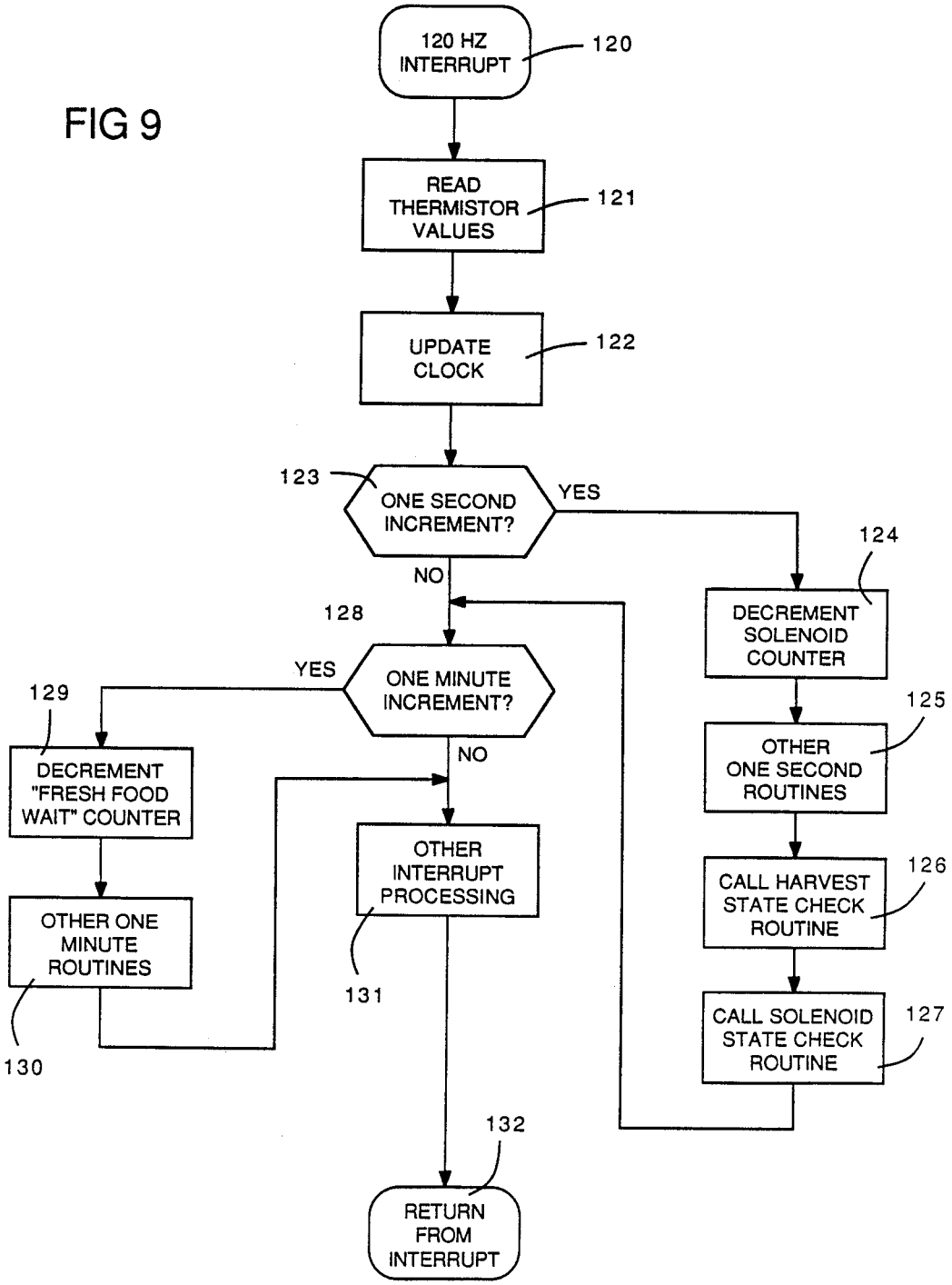
FIG. 9 is a flow chart of the 120 HZ INTERRUPT routine which forms a part of the software executed by the control system of FIG. 6.

Referring to FIG. 9, a 120 Hz interrupt routine is entered at block 120 each time a pulse is received on the 120 Hz interrupt line 55. The first step in the 120 Hertz interrupt routine at block 121 is to read the current values of sensors $T_1$ and $T_2$. This is accomplished as follows. Referring to FIG. 6, the multiplexer 68 selects the output of one of the V/F converters 64 or 65, and applies the selected signal to a timer input of the microprocessor 50. The timer input is connected to an internal counter (not shown) in the microprocessor 50 which counts the number of pulses occurring on the input line 70. The multiplexer select line 69 is set to select one of the V/F outputs 64 or 65 for a period of time equal to three periods of the 120 Hertz interrupt, or approximately 25 milliseconds (mS). At the end of the third interrupt period, the internal counter is read, and the number of counts is used as an index into a lookup table contained in ROM 58 to convert the value of the count into a corresponding temperature reading for the selected sensor $T_1$ or $T_2$. Then the multiplexer select input line 69 is changed to the alternate state to select the other sensor $T_1$ or $T_2$ to be measured during the next three interrupt periods in the same manner. Each time a temperature reading of either $T_1$ or $T_2$ is taken, the resulting temperature value is stored in RAM 57 in locations 135 and 136, respectively. The most current temperature readings are thereby available for processing as described below.

Referring again to FIG. 9, after processing the thermistor inputs as described above in block 121, processing proceeds to block 122. At block 122 a real time clock is updated with a value equal to the period of one 120 Hertz interrupt, or approximately 8.3 mS. The real time clock corresponds to an actual time of day which is normally displayed on the four digit display 73 (FIG. 6).

After processing the clock functions in block 122, a test is made at block 123 to determine if the real time clock is at a one second increment, e.g. every 120th interrupt cycle. If so, then a branch is taken to block 124. At block 124, a SOLENOID TIME COUNT 133 is decremented. The SOLENOID TIME COUNT 133 is a memory location in RAM 57 (FIG. 5) that is used to count the number of seconds that the water solenoid valve 21 remains activated. The manipulation and use of the SOLENOID TIME COUNT 133 is performed in other routines, described below, but it is decremented in block 124 at one second intervals as a count of the number of seconds elapsed.

From block 124, processing proceeds to block 125 where other routines (not shown) which need to be processed at one second intervals are performed. Then at block 126, a "HARVEST STATE CHECK" routine is called. The HARVEST STATE CHECK routine is an important part of this invention, described in detail below, in which a determination is made when to initiate an ice harvest cycle, based on the monitoring of both sensors $T_1$ and $T_2$, in order to maintain the fresh food compartment 16 at a stable temperature. After the HARVEST STATE CHECK routine at block 126, a SOLENOID STATE CHECK routine is called at block 127. The SOLENOID STATE CHECK routine is another important part of this invention in which the state of the water solenoid valve 21 is monitored to insure that is does not remain energized for prolonged periods of time. Upon returning from the SOLENOID STATE CHECK routine at block 127, the "one second" processing is complete and a branch is made to decision block 128. Block 128 is alternatively entered directly form decision block 123 if the interrupt being processed is not at a one second interval.

At decision block 128, a test is made to determine if the real time clock is at a one minute increment, e.g. every (60 * 120) interrupt cycles. If so, then a branch is made to block 129 where a "FRESH FOOD WAIT" counter 146 is decremented. The FRESH FOOD WAIT counter 146 is also a memory location in RAM 57 that is used by the HARVEST STATE CHECK routine in controlling the ice harvest cycles, as will be described in detail below. In block 129, the FRESH FOOD WAIT counter 146 is decremented at one minute intervals, and so serves as a "timer" of the number of minutes elapsed.

From block 129, processing proceeds at block 130 where other routines may be performed on a one minute periodic basis. Block 131 is entered either upon completion of the one minute routines at block 130 or directly from decision block 128 if the real time clock was not at a one minute increment. In process block 131, other routine interrupt processing may be performed before returning from the interrupt at block 132.

Figure 10:
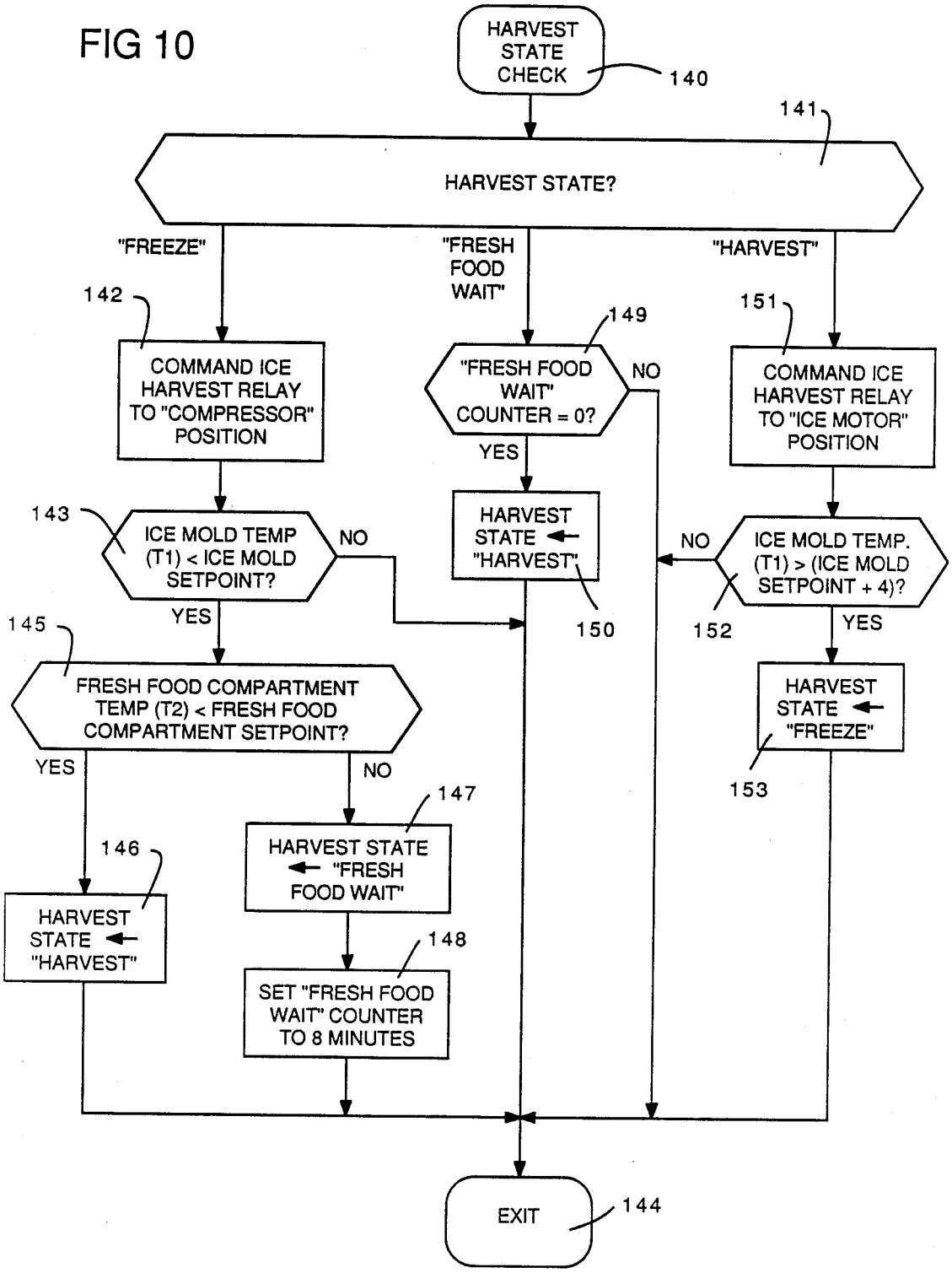
FIG. 10 is a flow chart of the HARVEST STATE CHECK routine which is called by the 120 HZ INTERRUPT routine of FIG. 9.

Referring to FIG. 10, the HARVEST STATE CHECK routine is entered at block 140 and proceeds to decision block 141. At decision block 141, a HARVEST STATE variable 155 is examined. The HARVEST STATE variable 155 is a memory location in RAM 57 (FIG. 5) which is used to store a code indicating the current state of an ice harvest cycle. There are three harvest states; namely a "freeze" state, a "fresh food wait" state, and a "harvest" state. Generally, the control strategy implemented by the HARVEST STATE CHECK routine is as follows. In the "freeze" state, sensor $T_1$ is monitored to determine when the water in the ice mold 17 becomes frozen. At that point, prior ice making control system would automatically initiate an ice harvest cycle. However, in this invention, a test is first made of sensor $T_2$ in the fresh food compartment 16. If sensor $T_2$ is not below its setpoint value 157, then the ice harvest cycle is delayed for a period of eight minutes to allow additional cooling for the fresh food compartment 16. That waiting period is performed with the harvest state in the "fresh food wait" state. After the eight minute period has elapsed in the "fresh food wait" state, an ice harvest is initiated by entering the "harvest" state. Alternatively, if sensor $T_2$ is already below its setpoint value 157 at the time that the water in the ice mold 17 becomes frozen, then an ice harvest cycle is initiated without delay by transitioning the harvest state directly from the "freeze" state to the "harvest" state.

Still referring to FIG. 10, the HARVEST STATE variable 155 is interrogated at block 141. If the HARVEST STATE variable 155 is in the "freeze" state, then a branch is taken to block 142. At block 142, the ice harvest relay 85 (FIG. 4) is commanded to the "compressor" position. As described above, in that position the refrigeration compressor 92 will operate, provided that the ice maker unit 13 is not in the midst of an ice harvest cycle. As the compressor 92 runs, heat is extracted from the ice mold 17. As the heat is removed, the ice mold 17, and the water contained therein, are cooled until the water reaches its freezing point of 0° C. (32° F.). As heat continues to be extracted, the temperature of the ice mold remains approximately at the freezing point until the water in the mold has given up its latent heat of solidification (e.g. is frozen), at which time the temperature of the ice mold 17 again starts to decrease. At decision block 143, if the ice mold temperature, as determined by the current reading 135 of sensor $T_1$, is not yet below the ice mold setpoint temperature 156, then a branch is taken directly to exit 144, and the HARVEST STATE 155 remains in the "freeze" state waiting for the ice to freeze.

Eventually, at block 143 during successive passes through the HARVEST STATE CHECK routine, the ice mold temperature reading 135 will fall below the ice mold setpoint temperature 156, and a branch will be taken to decision block 145. At decision block 145, a test is made to determine if the temperature in the fresh food compartment 16, as determined by the reading 136 of sensor $T_2$, is below the fresh food compartment setpoint temperature 157. If it is, then an ice harvest can be initiated without delay, and a branch is taken to block 146 where the HARVEST STATE variable 155 is set to "harvest". From block 146, a branch is taken to exit 144.

Conversely, if at block 145 the fresh food compartment temperature 136 is not below its setpoint value 157, then a branch is taken to block 147 where the HARVEST STATE variable 155 is set to the "fresh food wait" state. Then at block 148, the FRESH FOOD WAIT counter 154 is set to a value of "eight", corresponding to the number of minutes to be spent in the "fresh food wait" state. From block 148, a branch is taken to the exit at block 144.

Back at decision block 141, if the HARVEST STATE variable 155 is already in the "fresh food wait" state, then a branch is taken to decision block 149. At decision block 149, a test is made to determine if the FRESH FOOD WAIT counter 154 has been decremented down to zero. As noted above, the FRESH FOOD WAIT counter was initially set to eight minutes in block 148 and is decremented each minute at block 129 of FIG. 9. If the FRESH FOOD WAIT counter has not been decremented to zero, then the eight minute waiting period has not yet elapsed, and a branch is taken directly to exit 144. Alternatively, if the FRESH FOOD WAIT counter 154 has decremented to zero at block 149, a branch is taken to block 150. At block 150, an ice harvest cycle is initiated by setting the HARVEST STATE variable 155 to "harvest" before exiting at block 144.

Again at decision block 141, if the HARVEST STATE 155 is in the "harvest" state, then a branch is taken to block 151. At block 151, the ice harvest relay 85 is commanded to the "ice motor" position, thereby initiating an ice harvest cycle as described above. Processing then proceeds to decision block 152. In the "harvest" state, the ice will eventually be ejected from the ice mold 17 and a new charge of water admitted near the end of the ice harvest cycle. When the new water charge is admitted, the temperature of the ice mold 17 rises substantially. When that rise in temperature is detected, specifically a rise of 4° F. above the ice mold setpoint temperature 156 in this embodiment, the HARVEST STATE variable 155 as changed back to "freeze".

At decision block 152, a test is made to determine if the temperature 135 of the ice mold 17 has risen to a temperature 4° F. above the ice mold setpoint value 156. If not, then the "harvest" mode remains in effect and a branch is taken to exit 144. However, if the temperature of the ice mold 17 has risen 4° F. above the ice mold set point value 156, then a branch is taken to block 153 where the HARVEST STATE variable 155 is once again put in the "freeze" state. Note that even though the HARVEST STATE variable 155 is reset to the "freeze" state, the actual ice harvest cycle continues until the ice harvest motor 26 has completed its cycle, restoring the hold contacts 98 to their normal position thereby allowing the compressor motor 92 to again be energized. From block 153, the harvest state check routine exits a block 144.

Figure 11:
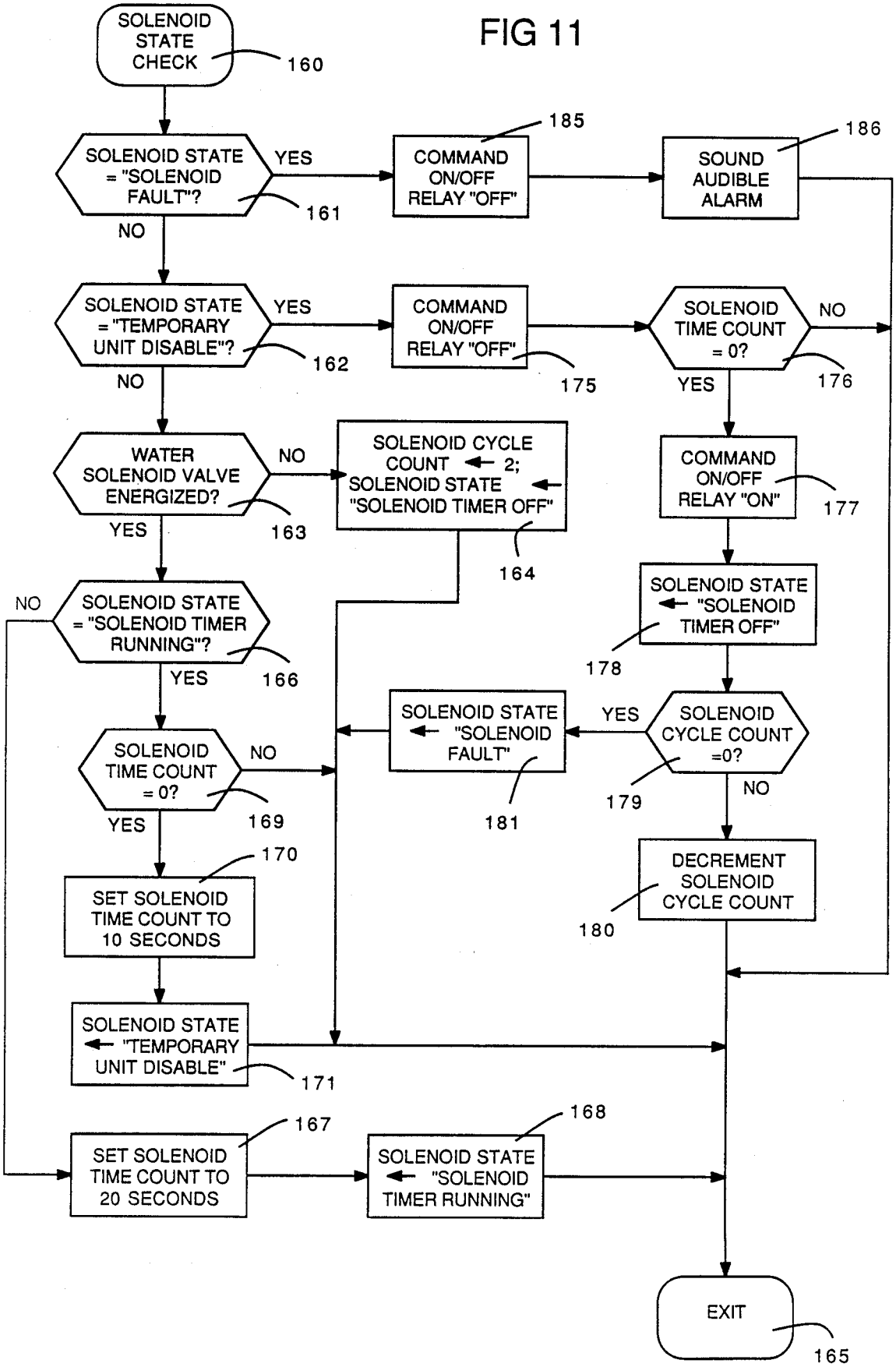
FIG. 11 is a flow chart of the SOLENOID STATE CHECK routine which is called by the 120 HZ INTERRUPT routine of FIG. 9.

Referring to FIG. 11, the SOLENOID STATE CHECK routine is also state driven, with four defined states: a "solenoid timer off" state, a "solenoid timer running" state, a "temporary unit disable" state, and a "solenoid fault" state. The current solenoid state is retained as an appropriate code in a SOLENOID STATE variable 178 in RAM 57 (FIG. 7). A general description of those states is as follows. As long as the water solenoid valve 21 is de-energized, the solenoid state remains in the "solenoid timer off" state. As soon as the water solenoid valve 21 is energized, a twenty second count is started, and the solenoid state is changed to the "solenoid timer running" state. The SOLENOID TIME COUNT 133 mentioned above is used for timing the twenty second period.

While in the "solenoid timer running" state, the water solenoid valve 21 continues to be monitored, and if it is found to be de-energized after the normal 5 to 8 second interval, the the "solenoid timer off" state is re-entered. On the other hand, if the solenoid state remains in the "solenoid timer running" state for the full twenty second count without the water solenoid valve 21 being de-energized, then a transition is made to the "temporary unit disable" state.

In the "temporary unit disable" state, power to the entire refrigeration system is cut off via ON/OFF relay 84 in an attempt to clear the water solenoid fault. The solenoid state remains in the "temporary unit disable" state for a period of ten seconds, after which power is restored to the refrigeration system. The SOLENOID TIME COUNT 133 is also used for timing the ten second "temporary unit disable" period. A SOLENOID CYCLE COUNT 179 is also maintained in RAM 57 (FIG. 7) as the number of consecutive times that the "temporary unit disable" state is entered, e.g. without detecting the water solenoid valve 21 as being de-energized. After three attempts to clear the fault by cycling power off for the ten second "temporary unit disable" periods, the "solenoid fault" state is entered. Once in the "solenoid fault" state, the water solenoid valve 21 is forced off indefinitely by again removing power from the entire refrigeration system. The "solenoid fault" state can only be reset through manual intervention, specifically by cycling power to the entire ice making unit 1 off and on by successive manual depressions of the ON/OFF switch 78 on the keyboard/display unit 72.

A detailed description of the SOLENOID STATE CHECK routine can now be presented. The SOLENOID STATE CHECK routine enters at block 160 and proceeds to a series of decision blocks 161 and 162, respectively, to determine if the SOLENOID STATE variable 178 is in either the "solenoid fault" or "temporary unit disable" states. If neither the "solenoid fault" nor "temporary unit disable" states are active, processing passes through decision blocks 161 and 162 to decision block 163.

At decision block 163, a test is made to determine if the water solenoid valve 21 is energized. If it is not, e.g. a quiescent period between ice harvest cycles, then processing branches to block 164. In block 164 the SOLENOID CYCLE COUNT 179 is initialized to a value of "two". As mentioned above, the SOLENOID CYCLE COUNT 179 is used as a count of the number of times that power has been cycled in attempting to clear a solenoid fault. Three such attempts are conducted in this embodiment, with the SOLENOID CYCLE COUNT 179 being initialized to two, and decrementing down to zero. Also in block 164, the SOLENOID STATE variable 178 is set to the "solenoid timer off" state. From block 164, a branch is taken directly to exit 165.

Back at decision block 163, once an ice harvest cycle has been initiated, the water solenoid valve 21 will be found to be energized, and a branch is taken to decision block 166. At decision block 166, a test is made to determine if the SOLENOID STATE variable 178 corresponds to the "solenoid timer running" state. If it is not, then the "solenoid timer off" state must be active, and a branch is taken to block 167. At block 167, the SOLENOID TIME COUNT 133 is initialized to twenty seconds. As described above, the SOLENOID TIME COUNT 133 is decremented at one second intervals in the 120 Hz interrupt routine of FIG. 7. Processing then proceeds at block 168 where the SOLENOID STATE variable 178 is set to the "solenoid timer running" state. From block 168, a branch is taken to the exit at block 5.

Once the "solenoid timer running" state has been entered, decision block 166 will branch to decision block 169, where a test is made to determine if the SOLENOID TIME COUNT 133 has decremented down to zero. If not, then the twenty second time period has not elapsed, and a branch is taken directly to the exit at 165. Once the twenty second time period has elapsed, the SOLENOID TIME COUNT 133 will be found to be zero at decision block 169, and a branch is taken to block 170. At this point, a fault condition has been detected in that the water solenoid valve 21 has been energized for a period of time exceeding the twenty second limit. If at any time during that period, the water solenoid valve 21 had been found to be de-energized, then the cycle would have been reset via a branch from decision block 163 to the initialization in block 164. Therefore, when the SOLENOID TIME COUNT 133 is found to be zero at decision block 169, processing proceeds to blocks 170 and 171, where the "temporary unit disable" state is initialized by setting the SOLENOID TIME COUNT 133 to ten seconds and setting the SOLENOID STATE variable 178 to "temporary unit disable", respectively. From block 171, a branch is taken to the exit at block 165.

Back at decision block 162, if the SOLENOID STATE variable 178 is found to be in the "temporary unit disable" state, then a branch is taken to block 175. After de-energizing the main ON/OFF relay 84 at block 175, processing proceeds to decision block 176, where a test is made to determine if the SOLENOID TIME COUNT 133 has decremented down to zero. If not, then the ten second "temporary unit disable" period has not yet elapsed, and a branch is taken directly to the exit at block 165. Alternatively, when the SOLENOID TIME COUNT 133 has decremented down to zero, indicating the end of the ten second "temporary unit disable" state, then a branch is taken from decision block 176 to block 177.

At block 177, the main ON/OFF relay 84 is re-energized. Then at block 178, the SOLENOID STATE variable 178 is reset to the "solenoid timer off" state. From block 178, processing continues at decision block 179, where a test is made to determine if the SOLENOID CYCLE COUNT 179 has decremented down to zero. If the SOLENOID CYCLE COUNT 179 has not yet been decremented to zero, then less than three attempts at clearing the solenoid fault have been made, and a branch is taken to block 180. In block 180, the SOLENOID CYCLE COUNT 133 is decremented to reflect the "temporary unit disable" cycle just completed. From block 180, a branch is taken to the exit at block 165.

On the other hand, if at decision block 179 the SOLENOID CYCLE COUNT 179 has already been decremented down to zero, then the three attempts to clear the fault have been exhausted, and a branch is taken to block 181. At block 181, the SOLENOID STATE variable 178 is set to the "solenoid fault" state, and then a branch is taken to exit 165.

Back at decision block 161, when the SOLENOID STATE variable 178 is found to be in the "solenoid fault" state, a branch is taken to block 185 where the main ON/OFF relay 84 is commanded to the "off" position. From block 185, processing proceeds at block 186 where an audible alarm is sounded to indicate the fault condition. From block 186, a branch is taken to the exit at block 165. It should be noted that once the "solenoid fault" state is entered, it remains active, holding the main ON/OFF relay 84 off and providing an audible alarm, until manually reset by other routines (not shown) in response to manual entries from the keyboard 72.

I claim:

1. In a unitary ice maker with fresh food compartment of the type including a fresh food compartment, a freezer compartment containing an automatic ice making unit, the automatic ice making unit including an ice mold, a first temperature sensing means in thermal contact with the ice mold for producing a first signal indicative of the temperature of the ice mold, and means for harvesting ice from the ice mold, and refrigeration means for producing ice in the automatic ice making unit, the improvement wherein the unitary ice maker with fresh food compartment further comprises:

second temperature sensing means exposed to the fresh food compartment for producing a second temperature signal indicative of the temperature of the interior of the fresh food compartment;

ice maker control means connected to the refrigeration means and to the first and second temperature signals for initiating an ice harvest in the automatic ice making unit by monitoring the first temperature signal to determine the time at which ice in the automatic ice making unit is ready to be harvested, and at that time, then monitoring the second temperature signal to determine if the temperature of the fresh food compartment is below a predetermined setpoint temperature, whereby if at the time that the ice in the automatic ice making unit is ready to be harvested, the temperature of the fresh food compartment is above the setpoint temperature, then the ice harvest is delayed to allow additional cooling of the fresh food compartment.

2. The improvement of claim 1 in which the ice maker control means comprises a microprocessor system including memory means.

3. The improvement of claim 2 in which the first temperature sensing means comprises an electronic transducer in thermal contact with the ice mold.

4. The improvement of claim 2 in which the value of the setpoint temperature is stored in the memory means and the microprocessor system includes input/output means for manually setting the value of the setpoint temperature.

5. The improvement of claim 1 in which the automatic ice making unit includes a water solenoid valve for admitting water into the ice mold, and the ice maker control means includes means for sensing the presence of an energizing voltage on the water solenoid valve, and on/off control means for removing operating voltage from the automatic ice making unit, wherein if the water solenoid valve remains energized for a period of time exceeding a predetermined time limit, then the ice maker control means deactivates the on/off control means to remove the operating voltage from the automatic ice making unit, thereby de-energizing the water solenoid valve.

6. In an ice maker of the type which includes an automatic ice making unit with a water solenoid valve for admitting water into an ice mold, the improvement wherein the ice maker further includes:

sensing means connected to the water solenoid valve for sensing the presence of an energizing voltage on the water solenoid valve and producing a solenoid active signal when the energizing voltage is present;

on/off control means for removing operating voltage from the automatic ice making unit; and ice maker control means connected to the sensing means and to the on/off control means for preventing prolonged water flow through the water solenoid valve by monitoring the solenoid active signal, and if the solenoid active signal remains true for a period of time exceeding a first predetermined time period, then de-activating the on/off control means to remove the operating voltage from the automatic ice making unit, thereby de-energizing the water solenoid valve.

7. The improvement of claim 6 in which once the on/off control means is deactivated in response to the solenoid active signal exceeding the predetermined time limit, then after a second predetermined time period the on/off control means is reactivated to again apply operating voltage to the automatic ice making unit, whereby if the solenoid active signal again remains true for a period of time exceeding the first predetermined time period, then the on/off control means is again deactivated.

8. The improvement of claim 7 in which the reactivation of the on/off control means is attempted a maximum of three times, after which if the solenoid active signal continues to exceed the first predetermined time period, then the on/off control means remains deactivated until reset through manual intervention.

* * * * *